US007182447B2

(12) United States Patent
Anderson, Jr. et al.

(10) Patent No.: US 7,182,447 B2
(45) Date of Patent: Feb. 27, 2007

(54) WICK FOR AN INKJET PRINTHEAD

(75) Inventors: James D. Anderson, Jr., Harrodsburg, KY (US); Johnnie Coffey, Winchester, KY (US); David W. DeVore, Richmond, KY (US); Bruce Gibson, Lexington, KY (US); Trevor D. Gray, Midway, KY (US); Gina M. Johns, Nicholasville, KY (US); Sam Norasak, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 179 days.

(21) Appl. No.: 11/018,203

(22) Filed: Dec. 20, 2004

(65) Prior Publication Data

US 2006/0132561 A1 Jun. 22, 2006

(51) Int. Cl.
*B41J 2/175* (2006.01)
*B41J 2/17* (2006.01)

(52) U.S. Cl. ..... 347/86; 347/84

(58) Field of Classification Search ..... 347/87, 347/84, 86

See application file for complete search history.

(56) References Cited

U.S. PATENT DOCUMENTS

| | | | | |
|---|---|---|---|---|
| 5,576,750 | A * | 11/1996 | Brandon et al. | 347/87 |
| 5,886,721 | A * | 3/1999 | Fujii et al. | 347/87 |
| 6,033,063 | A * | 3/2000 | Tomikawa et al. | 347/87 |
| 6,264,315 | B1 * | 7/2001 | Nozawa et al. | 347/86 |
| 6,682,183 | B2 * | 1/2004 | Jones et al. | 347/85 |
| 2005/0151808 | A1 * | 7/2005 | Andersen et al. | 347/86 |

* cited by examiner

*Primary Examiner*—Manish S. Shah
*Assistant Examiner*—Han Samuel Choi
(74) *Attorney, Agent, or Firm*—Michael, Best & Friedrich

(57) ABSTRACT

Some embodiments of the present invention provide an inkjet printhead within which a removable ink cartridge can be installed. Upon installation, the ink cartridge can be coupled to one or more wicks in the printhead for establishing fluid communication between one or more chambers in the ink cartridge and nozzles through which ink exits the printhead during operation. The wick can extend from a cartridge receptacle to a filter in order to transport ink from the removable cartridge to the filter. In some embodiments, the wick is retained in place within the printhead by a cap, which can be coupled to one or more filter towers. The wick can have upstream and downstream interfaces that can be the same or different in shape and/or size.

44 Claims, 4 Drawing Sheets

WICK FOR AN INKJET PRINTHEAD

This application is filed concurrently with a corresponding and co-owned United States Patent Application entitled "Bridging Wick and Method for an Inkjet Printhead".

BACKGROUND OF THE INVENTION

Conventional inkjet printers typically include one or more printheads in which ink is stored. Such printheads have one or more ink reservoirs in fluid communication with a nozzle plate through which ink is dispensed onto a print medium. In some cases, the printhead is adapted to be refilled with ink, such as by a ink-carrying cartridge that can be installed in the printhead and that can be replaced with another ink-carrying cartridge as needed.

In printheads having a removable and replaceable ink cartridge, an outlet of the cartridge is typically connected to a port or other structure of the printhead when the cartridge is installed within the printhead. This connection establishes fluid communication between a reservoir of ink within the cartridge and a fluid line of the printhead extending to the nozzle plate. To insure proper operation of the printhead, the interface between the cartridge outlet and the printhead should provide an uninterrupted path for ink moving from the cartridge toward the nozzle plate. The path can be interrupted, for example, by bubbles or when the cartridge outlet-to-printhead interface is allowed to dry out. In both cases, the printhead can lose prime, thereby stopping ink flow and causing printhead failure.

A clear and uninterrupted fluid path from a removable and replaceable ink cartridge to a printhead nozzle promotes proper operation of the printhead. Inkjet printheads are typically designed with this goal in mind, employing conventional materials and fluid flow features promoting free ink movement from the cartridge to the nozzle plate.

SUMMARY OF THE INVENTION

In some embodiments of the present invention, a printhead adapted to receive a removable ink cartridge is provided, and comprises a receptacle having an interior and adapted to removably receive a removable ink cartridge; and a wick exposed to the interior of the receptacle when the removable ink cartridge is removed from the receptacle, exposure of the wick to the interior of the receptacle restricted to a first external surface area of the wick; wherein ink flows from the wick to a downstream location in the printhead via a second external surface area of the wick that is greater than the first external surface area of the wick.

Some embodiments of the present invention provide a printhead adapted to receive a removable ink cartridge, wherein the printhead comprises a receptacle dimensioned to receive a removable ink cartridge; a nozzle through which ink exits the printhead; a filter located in a fluid path extending from the receptacle to the nozzle; and a wick having a first portion positioned to be releasably coupled to an outlet of the removable ink cartridge when the removable ink cartridge is installed within the receptacle, the first portion having a total amount of surface area exposed to an interior of the receptacle when the removable ink cartridge is removed from the receptacle; and a second portion coupled to the filter and located along the fluid path downstream of the first portion, the second portion having a total amount of surface area in contact with the filter, wherein the total amount of surface area of the wick exposed to the interior of the receptacle when the removable ink cartridge is removed is less than the total amount of surface area of the wick in contact with the filter.

In some embodiments of the present invention, a printhead adapted to receive a removable ink cartridge is provided, and comprises a housing; and a wick positioned with respect to the housing to be releasably coupled to an ink cartridge when the removable ink cartridge is installed in the printhead, the wick comprising at least one surface defining a first interface through which ink enters the wick from the removable ink cartridge; at least one surface defining a second interface through which ink exits the wick; and a cross-sectional area defined by a plane substantially perpendicular to an ink flow path extending from the first interface to the second interface, wherein the cross-sectional area of the wick changes between the first interface and the second interface of the wick.

A more complete understanding of the present invention, together with the organization and manner of operation thereof, will become apparent from the following detailed description of exemplary embodiments of the invention when taken in conjunction with the accompanying drawings, wherein like elements have like numerals throughout the drawings.

Figure 1:
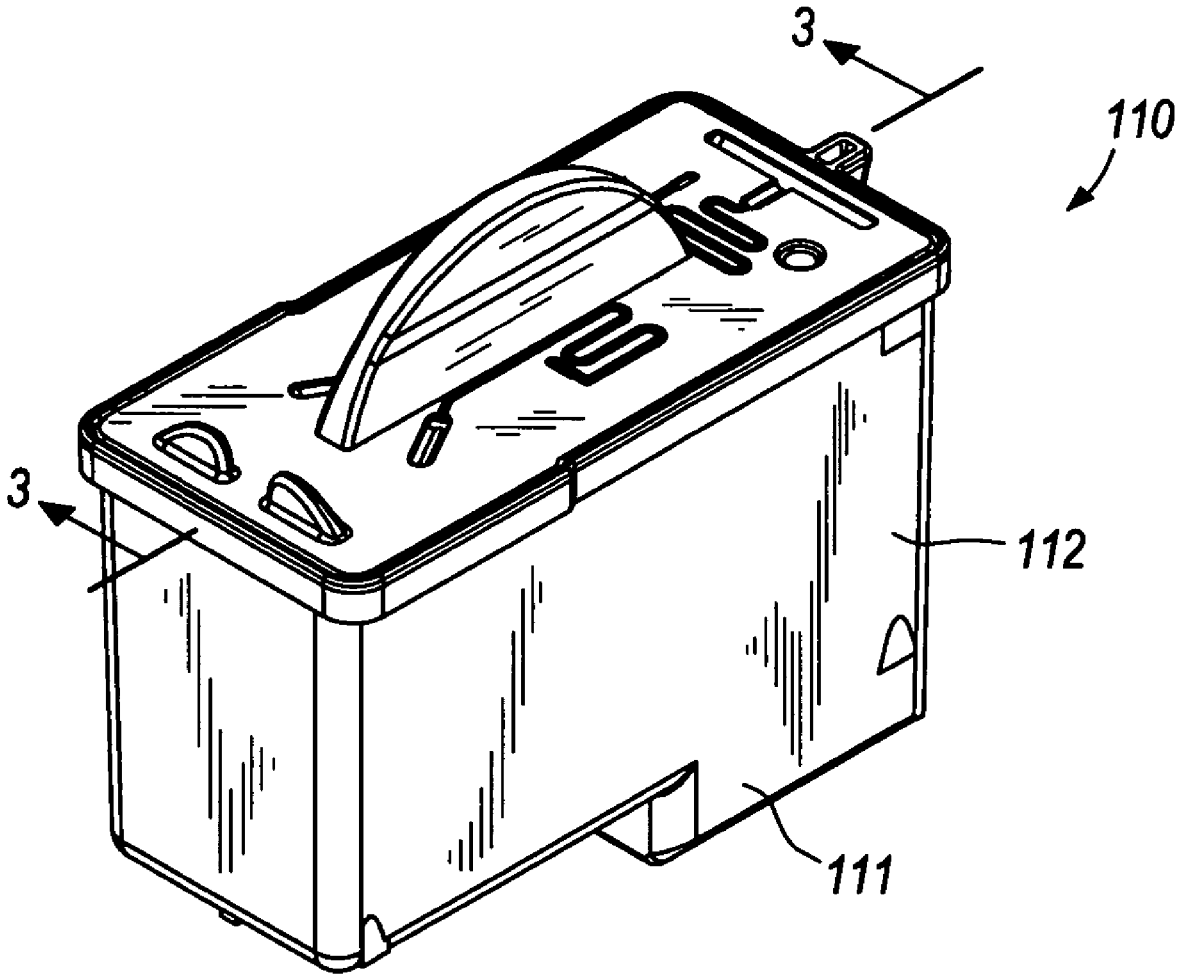
FIG. 1 is a perspective view of a printhead according to an embodiment of the present invention.

Before the various exemplary embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

As used herein and in the appended claims, the term "ink" can refer to at least one of inks, dyes, stains, pigments, colorants, tints, a combination thereof, and any other material that can be used by an inkjet printing apparatus to print matter upon a printing medium. As used herein and in the appended claims, the term "printing medium" can refer to at least one of paper (including without limitation stock paper, stationary, tissue paper, homemade paper, and the like), film, tape, photo paper, a combination thereof, and any other medium upon which material can be printed by an inkjet printing apparatus, such as a printer.

As used herein, the term "chip" can refer to one or more layers of material having one or more arrays of nozzles (not shown), transducers (not shown), and/or firing chambers (also not shown), at least one of the one or more layers being in fluid communication with an ink reservoir. In other embodiments, nozzles defining outlets of the printhead can be located in other elements of the printhead. In embodiments in which the printhead has more than one ink reservoir (described in greater detail below), the chip can be coupled to the printhead such that each of multiple ink reservoirs is in fluid communication with a respective set of transducers, firing chambers, and/or nozzles in the chip.

In some embodiments described and illustrated herein, ink is directed along a path from an ink reservoir toward an outer surface of a printhead (and a chip, when a chip is coupled to the outer surface), such that ink enters one or more firing chambers, and is eventually fired from corresponding nozzles. Also, in some embodiments, ink located in a firing chamber can be, for example, heated and vaporized by signaling a corresponding heat transducer to heat up ink in the firing chamber. The ink can then be expelled outwardly from the printhead through a corresponding nozzle toward a printing medium. Still other manners of expelling ink from the printhead are possible, and fall within the spirit and scope of the present invention. The chip can be in electrical communication with a printer controller that controls when various nozzles of the chip fire ink toward a printing medium.

Figure 2:
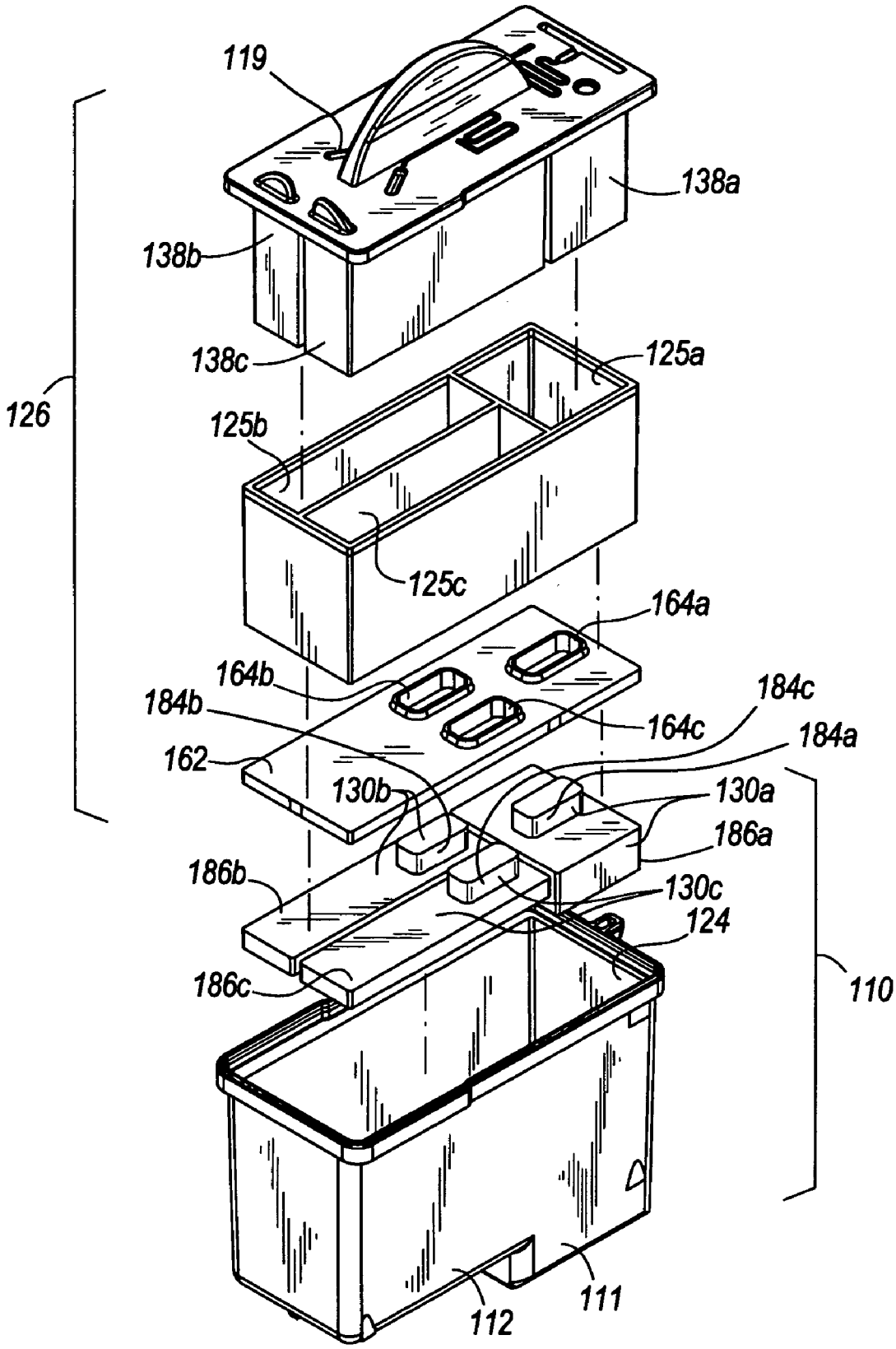
FIG. 2 is an exploded perspective view of the printhead illustrated in FIG. 1, shown with a removable ink cartridge.
Figure 3:
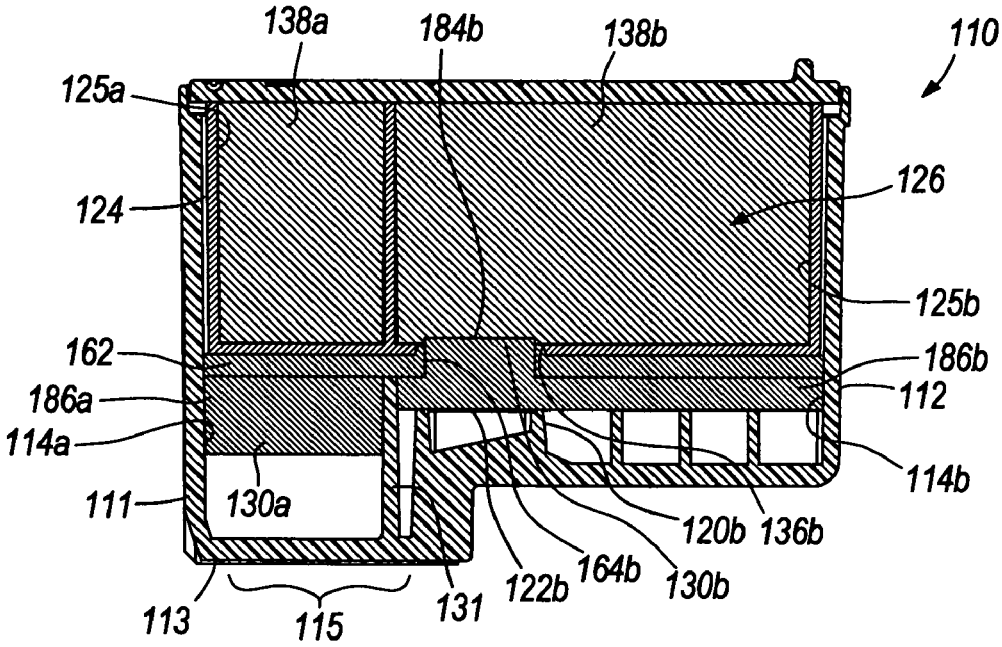
FIG. 3 is a cross-sectional side view of the printhead illustrated in FIGS. 1 and 2, taken along lines 3—3 of FIG. 1.

With reference now to FIGS. 1–3, the printhead 110 illustrated in FIGS. 1–3 has a housing 112 with a nosepiece 111 and a chip 113 (see FIG. 3) through which ink is dispensed during printing operations. The housing 112 has three ink reservoirs 114*a*, 114*b*, 114*c* defined at least in part by walls of the housing 112. A supply of ink is stored in each of the three ink reservoirs 114*a*–*c*. In other embodiments, the printhead 110 can have a single ink reservoir 114, or can have two, four, or more ink reservoirs 114, which may be at least partially defined by walls of the housing 112, each reservoir 114 carrying a respective supply of ink.

The same ink can be stored in each of the ink reservoirs 114*a*–*c* illustrated in FIGS. 1–3. However, additional benefits can be obtained by storing different types of ink (e.g., ink having different colors and tones) in each of the reservoirs 114*a*–*c*. For example, the printhead 110 illustrated in FIGS. 1–3 can be used to print in color when the three ink reservoirs 114*a*–*c* house cyan, yellow, and magenta ink, respectively. Any other combination of any other ink colors and tones can be used as desired.

Each of the ink reservoirs 114*a*–*c* illustrated in the embodiment of FIGS. 1–3 is substantially cuboid in shape, although the ink reservoirs 114*a*–*c* can have any other shape desired. Also, the three ink reservoirs 114*a*–*c* illustrated in the embodiment of FIGS. 1–3 are arranged so that two reservoirs 114*b* and 114*c* are substantially elongated and parallel to one another, are at least partially separated by a wall (not visible in FIGS. 1–3) of the housing 112, and each have a relatively short end at least partially separated from the third reservoir 114*a* by a common wall 131. It should be noted that the arrangement of ink reservoirs 114*a*–*c* illustrated in FIGS. 1–3 is only one of many possible arrangements of the ink reservoirs 114*a*–*c*, and is presented by way of example only. Also, the three ink reservoirs 114*a*–*c* can each be substantially the same size or can have any combination of relative sizes (e.g., two of any three ink reservoirs 114*a*–*c* having substantially the same size, each of the three ink reservoirs 114*a*–*c* having different sizes, and the like).

In operation, each of the ink reservoirs 114*a*–*c* illustrated in FIGS. 1–3 is occupied by a respective ink retaining medium, such as a material or combinations of material capable of retaining fluid by capillary action, including without limitation felt, foam, sponge, and the like. During operation of the printhead 110, ink flows into and through a wick 130 in each ink reservoir 114*a*–*c*, then to a filter 122 and filter tower 120 (only one of each being visible in FIG. 3) to the printhead nozzles 115 in the amount demanded by the printing job being performed.

Although a filter tower 120 can extend from a bottom portion of an ink reservoir 114 as described above, the filter tower 120 can instead extend from any other portion of the ink reservoir 114 in which ink passes toward the nozzles 115 of the printhead 110 (e.g., through a side wall of the ink reservoir 114 in cases where the nozzles 115 are located on the side of the housing 112). The filter tower 120 in the embodiment of FIGS. 1–3 has a generally rectangular shape, although filter towers 120 having any other shape can be used as desired. In this regard, the filter tower 120 can be sized and shaped to allow the proper ink flow from the ink reservoir 114 toward the nozzles 115.

As mentioned above, the printhead 110 illustrated in FIGS. 1–3 has filters (see such as filter 122*b*). Each of the filters 122 can be coupled to a respective filter tower 120 in any of a variety of manners known in the art (e.g., laser welding, adhesive or cohesive bonding material, heat staking, etc.). A variety of types of filters 122 can be used. For example, the filter 122*b* shown in FIG. 3 is a woven filter with a relatively fine mesh size. In other embodiments, no filter is used.

The filter towers 120 are positioned such that each filter 122 contacts an ink retaining medium 138 in a receptacle 124 of the printhead 110 as described in greater detail below, or is otherwise located in the path of ink flow toward the nozzles 115 in those embodiments not having an ink retaining medium 138.

In the illustrated embodiment of FIGS. 1–3, the filters 122 (see filter 122*b* in FIG. 3) are coupled to the filter towers 120 in a generally horizontal relationship. In another embodiment, filters 122 might be coupled to the filter towers 120 at an angle with respect to horizontal (e.g., using a filter tower that is also angled). In such an embodiment, a corresponding wick might have an inclined surface that mates with the angled filter when installed.

As mentioned above, the printhead 110 can have a receptacle 124 housing in which an ink retaining medium 138 is received. The receptacle 124 can receive any number of ink retaining mediums 138, and in some cases has a different ink retaining medium 138 corresponding to each ink reservoir 114*a*–*c*. In some embodiments, each ink retaining medium 138 is part of an ink cartridge 126 that is removably receivable in a single receptacle 124 of the printhead 110. For example, the ink cartridge 126 illustrated in FIGS. 2 and 3 might have three internal chambers 125*a*–*c* for retaining three supplies of ink. Each internal chamber 125*a*–*c* is occupied by a respective ink retaining medium 138*a*–*c*, and has at least one respective outlet 136*a*–*c* (see FIG. 3) through which ink flows to exit the ink cartridge 126 (e.g., to a wick 130, as described in greater detail below). In some embodiments, the ink cartridge 126 may include one or more grooves that correspond to one or more walls (e.g., wall 131 in FIG. 3) in the ink receptacle 124 that may at least partially define the ink reservoirs 114*a*–*c*.

The ink cartridge 126 can have any number of internal chambers 125*a–c* for holding ink. When the ink cartridge 126 is fully installed in the printhead 110, each ink reservoir 114*a–c* can be in fluid communication with and be supplied with ink from a corresponding internal chamber 125*a–c* of the ink cartridge 126. However, in some alternative embodiments, the ink from two or more internal chambers 125*a–c* of the ink cartridge 126 can be in fluid communication with and can supply a common ink reservoir 114.

Accordingly, the ink cartridge 126 in the embodiment of FIGS. 1–3 can be installed to provide a supply of ink to each ink reservoir 114*a–c* in the printhead 110. However, in other embodiments, the printhead 110 receives two or more ink cartridges 126 for this purpose. For example, the receptacle 124 of the printhead 110 can be shaped and dimensioned to receive two or more ink cartridges 126 at the same time. As another example, the printhead 110 can have two or more receptacles 124, each of which can be shaped and dimensioned to receive one or more ink cartridges 126. With continued reference to FIGS. 1–3, the illustrated printhead 110 has a single receptacle 124 within which a single ink cartridge 126 having multiple chambers 125*a–c* and multiple outlets 136 is removably received.

Wicks 130*a–c,* as best illustrated in FIGS. 2 and 3, have a first portion 184*a–c* that is relatively short and has a substantially rectangular cross-sectional shape with rounded edges. Meanwhile, a second portion 186*a–c* has a substantially rectangular cross-sectional shape that is larger than that of the first portion 184*a–c.* In other embodiments, wicks 130*a–c* may have other cross-sections, including those that vary. Although a wick 130*a–c* that is retained in the printhead 110 when the ink cartridge 126 is removed is desirable, in other embodiments one or more of the wicks 130*a–c* is integral with the ink retaining medium(s) 138*a–c* of the ink cartridge 126.

Wicks 130*a–c* can comprise a material suitable for movement of ink along the wick 130*a–c,* such as by capillary action. Accordingly, wicks 130*a–c* can comprise felt, foam, sponge, and the like. In other embodiments, wicks 130*a–c* can provide other types of ink flow, and can comprise material(s) having less resistance to free ink movement. Moreover, in some embodiments, first portion 184 may comprise a material having a first density, while a second portion may comprise the same or similar material with a different density.

In some embodiments, fluid communication between a wick 130 and ink within the ink cartridge 126 is established by insertion of something into the cartridge outlet 136. For example, the wick 130 illustrated in FIGS. 2 and 3 has a protrusion, such as a first portion 184, that extends into the cartridge outlet 136 when the ink cartridge 126 is fully installed in the receptacle 124. In this manner, the protrusion 184 contacts the ink retaining medium 138 within the ink cartridge 126, thereby establishing a path of ink flow from the ink retaining medium 138 out of the cartridge outlet 136. In other embodiments, the wick 130 or a protrusion thereof does not extend into the cartridge outlet 136 to establish fluid flow from the ink cartridge 126. For example, the wick 130 can contact a portion of the ink retaining medium 138 that extends from the cartridge outlet 136 or that is substantially flush with an exterior of the cartridge outlet 136.

The protrusion illustrated in FIGS. 2 and 3 has a substantially rectangular cross-sectional shape and a relatively low profile with respect to the body of the wick 130 (e.g., second portion 186). However, the protrusion can have any other shape and size capable of performing the same fluid flow functions described above. In addition, in one embodiment, the protrusion (e.g., first portion 184) might be chamfered, which may reduce the force needed to effectuate fluid communication between the wick 130 and the ink cartridge 126. Also, in some embodiments the wick 130 might have multiple protrusions, each of which can establish fluid flow from the ink cartridge 126 through a common cartridge outlet 136 or through respective cartridge outlets 136.

As shown in FIGS. 2 and 3, the protrusion of each illustrated wick 130*a–c* has a shape and size corresponding to the shape and size of a respective cartridge outlet 136. In this manner, the amount of surface area of the ink retaining medium 138 exposed to the environment outside of the cartridge 136 is limited substantially to those surfaces through which ink flows. This limitation can help to prevent ink evaporation from the ink cartridge 126, and can protect the ink retaining medium 138 from drying out.

For example, a cap 162 having three apertures 164*a–c,* each aperture corresponding to a respective chamber 125*a–c* of the ink cartridge 126, can be provided over the second portions 186*a–c* of the wicks 130*a–c.* A first portion 184*a–c* of each wick 130*a–c* can extend through each aperture 164*a–c,* and establish fluid communication between ink within a corresponding chamber 125*a–c* and a corresponding filter 122*a–c.*

The cap 162 can have any orientation desired. For example, at least a portion of the cap 162 can be substantially vertical to separate the receptacle 124 corresponding to the one or more ink reservoirs 114*a–c.*

Upon establishment of fluid communication with the wick 130, ink from the ink cartridge 126 flows across an interface between the wick 130 and the ink retaining medium 138, and then along the wick 130 toward the filter 122. The path of ink along the wick 130 toward the filter 122 extends through the aperture 164 in cap 162, which otherwise substantially separates the ink cartridge 126 from the wick 130. As ink is consumed during printing operations, ink flows from the ink retaining medium 138 through the filter 122 and filter tower 120 (if employed), and through the nozzles 115 of the printhead 110. Therefore, ink is supplied to the filter 122 from a removable ink cartridge 126 with significantly reduced risk that the supply of ink to the filter 122 will be interrupted by ink evaporation or otherwise as a result of the environment around the printhead 110.

Figure 5:
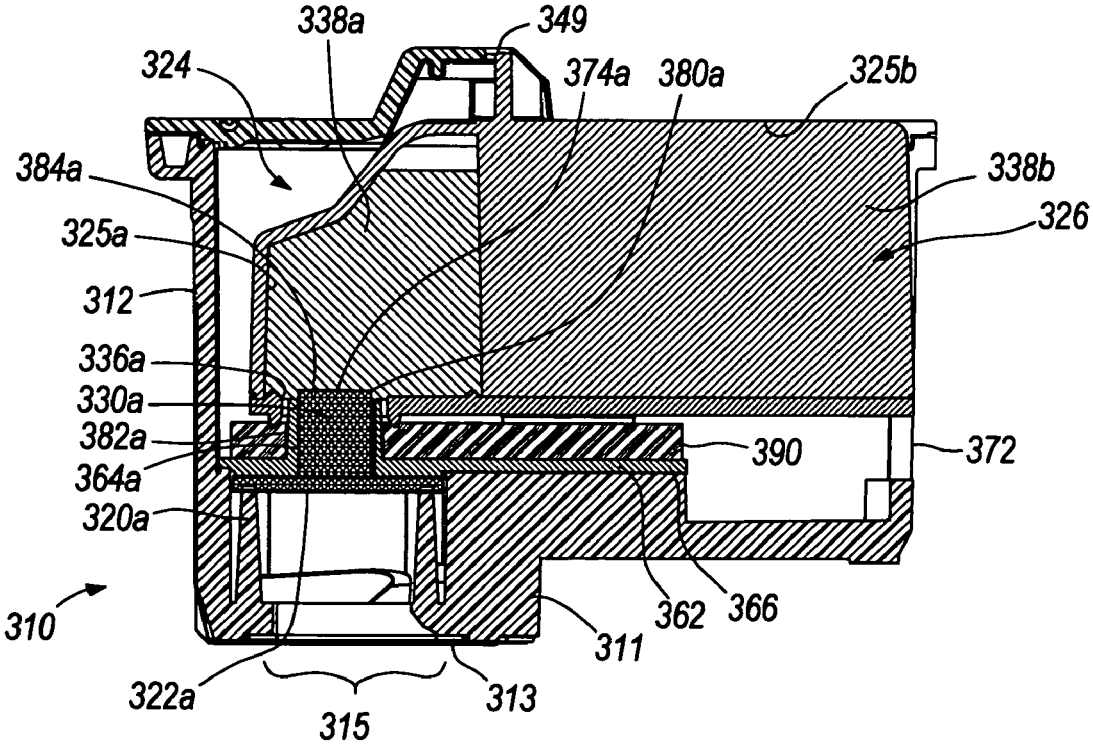
FIG. 5 is a cross-sectional side view of the printhead illustrated in FIG. 4, taken along line 5—5 of FIG. 4.
Figure 4:
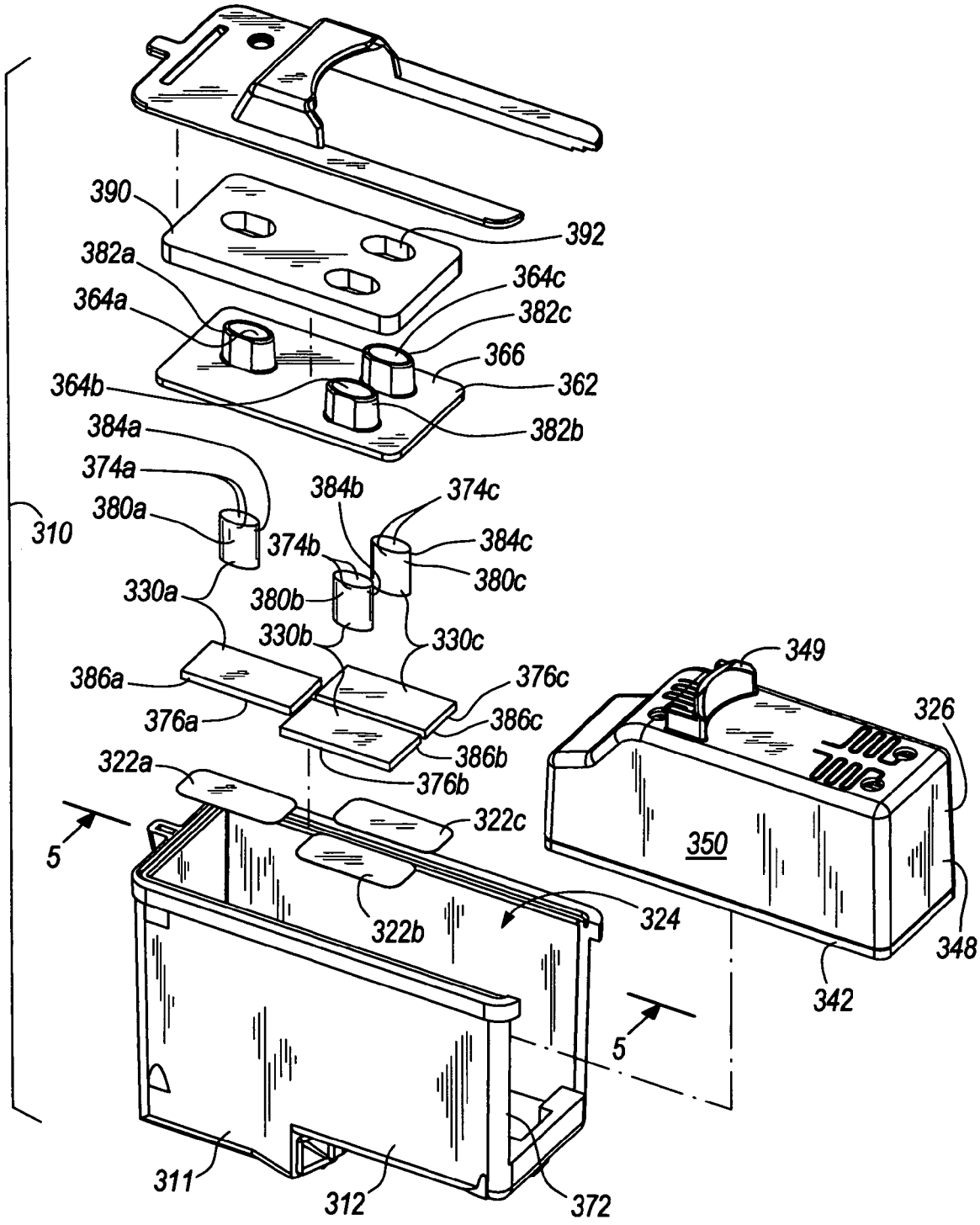
FIG. 4 is an exploded perspective view of a printhead according to another embodiment of the present invention, shown with a removable ink cartridge.

FIGS. 4 and 5 illustrate a printhead 310 according to yet another embodiment of the present invention, wherein like numerals represent like elements with respect to the printheads 110 described above and illustrated in FIGS. 1–3. The printhead 310 shares many of the same elements and features described above with reference to printhead 110 of FIGS. 1–3. Accordingly, elements and features corresponding to elements and features described above with reference to printhead 110 of FIGS. 1–3 are provided with the same reference numerals in the 300 series. Reference is made to the description above accompanying FIGS. 1–3 for a more complete description of the features and elements (and alternatives to such features and elements) of the printhead 310 illustrated in FIGS. 4 and 5.

The printhead 310 illustrated in FIGS. 4 and 5 has a housing 312 with a nosepiece 311 and a chip 313 through which ink is dispensed during printing operations. The printhead 310 is adapted to removably receive an ink cartridge 326, and is an example of another manner in which an ink cartridge 326 can be inserted into a printhead 310. In the printhead embodiment illustrated in FIGS. 1–3, the ink cartridges 126 is installed by downward insertion of the ink cartridge 126 into a receptacle 124 in the printhead 110. However, in the printhead 310 illustrated in FIGS. 4 and 5, the ink cartridge 326 is installed from a side 372 of the printhead 310. In this regard, the ink cartridges in the various embodiments described herein with reference to FIGS. 1–3 can be inserted in any manner and from any location, depending at least in part upon the shape of the housing 112 and 312 and the locations of the other printhead components.

As will be described in greater detail below, in the embodiment shown in FIGS. 4 and 5, ink flows from wicks 330*a*–*c* to the filters 322*a*–*c* and filter towers 320*a*–*c* (if employed), and to the nozzles 315. The housing 312 illustrated in FIGS. 4 and 5 has a receptacle 324 shaped and dimensioned to removably receive the ink cartridge 326. The receptacle 324 can take any of the forms and can have any of the features and elements, such as otherwise described herein.

For example, the printhead 310 illustrated in FIGS. 4 and 5 has a single receptacle 324 within which a single ink cartridge 326 having multiple chambers 325*a*–*c* (two of which are visible in FIG. 5) is removably received. However, the printhead 310 can instead have a single receptacle 324 shaped and dimensioned to removably receive an ink cartridge having a single chamber for connection with one or more wicks in the printhead. Alternatively, the printhead can instead have two or more receptacles, each of which is shaped and dimensioned to removably receive a respective ink cartridge having one or more chambers releasably connectable to corresponding wicks in the printhead.

The ink cartridge 326 illustrated in FIGS. 4 and 5 has a housing 348 within which a supply of ink is retained. In some embodiments, the housing 348 comprises a number of substantially rigid walls 350, one or more of which can define an exterior wall of the printhead 310 when the ink cartridge 326 is installed within the printhead 310. The housing 348 can also include a tab, flange, handle, or other user-manipulatable portion 349 enabling a user to grasp the ink cartridge 326 during cartridge insertion and removal operations. The user-manipulatable portion can have any shape suitable for this purpose.

The ink cartridge 326 can take any of the forms and have any of the features and elements described above with reference to the ink cartridge 126. For example, the ink cartridge 326 can have a single internal chamber for housing a supply of ink to be ejected from the printhead 310 during printing operations, or can have two or more chambers housing respective supplies of ink for this purpose (such as for color printing). The ink cartridge 326 illustrated in FIGS. 4 and 5 has three chambers 325*a*–*c*, only two of which are visible in FIG. 5. Each chamber 325*a*–*c* houses a respective supply of ink in fluid communication with the chip 313 when the ink cartridge 326 is fully installed in the printhead 310. The three chambers 325*a*–*c* can have any shape and can be arranged in any manner desired. Also, the three chambers 325*a*–*c* can each be substantially the same size or can have any combination of relative sizes (e.g., two of any three chambers 325*a*–*c* having substantially the same size, each of the three chambers 325*a*–*c* having different sizes, and the like).

In some embodiments, one or more of the chambers 325*a*–*c* in the ink cartridge 326 is at least partially occupied by an ink retaining medium 338*a*–*c* (described in greater detail above). Also, each chamber 325*a*–*c* of the ink cartridge 326 has a respective outlet 336*a*–*c*, only one of which is visible in FIG. 5. Ink flows through the outlets 336*a*–*c* to exit the chambers 325*a*–*c*. The outlets 336*a*–*c* can be located in one or more walls in any desired location of the housing 312. For example, the outlets 336*a*–*c* of ink cartridge 326 illustrated in FIGS. 4 and 5 are located in a single bottom wall 342 of the housing 312.

When the ink cartridge 326 is fully installed within the printhead 310, ink within each chamber 325*a*–*c* of the ink cartridge 326 is brought into fluid communication with the nozzles 315 via wicks 330*a*–*c* of high capillary material corresponding to each chamber 325*a*–*c*. The wicks 330*a*–*c* illustrated in FIGS. 4 and 5 each extend into a chamber 325*a*–*c* of the ink cartridge 326 and into contact with an ink retaining medium 338*a*–*c* in the chamber 325*a*–*c*. In other embodiments, the interface between each chamber 325*a*–*c* (and retaining medium 338*a*–*c*, if employed) of the ink cartridge 326 and the corresponding wick 330*a*–*c* can take any of the forms described above.

Each of the wicks 320*a*–*c* in the embodiment of FIGS. 4 and 5 has a first interface 374*a*–*c* through which ink is received in the wick 330*a*–*c* from the ink cartridge 326 and a second interface 376*a*–*c* through which ink exits the wick 330*a*–*c* as it flows toward the nozzles 315. In the illustrated embodiment of FIGS. 4 and 5, the first interface 374*a*–*c* includes a top surface (e.g., a 6 mm by 3 mm elliptical surface) of each wick 330*a*–*c* and the uppermost side surfaces (e.g., the top 1.5 mm of the first portion 384 of wicks 330) of each wick 330*a*–*c* providing an interface through which ink can pass when the cartridge 326 is fully installed in the printhead 310.

The first interface 374*a*–*c* can include one or more sides 380*a*–*c* of the wick 330*a*–*c* depending upon the manner in which the wick 330*a*–*c* is coupled to the ink cartridge 326 (e.g., inserted within a recess in the ink retaining medium 338*a*–*c* of the ink cartridge 326, and the like). The first interface 374*a*–*c* can have a number of shapes, such as rectangular, round, oval (e.g., elliptical), irregular, and other shapes, and can include any number of other surfaces of the wick 330*a* through which ink passes into the wick 330*a*–*c*. The second interface 376*a*–*c* of each wick 330*a*–*c* is substantially rectangular in shape in FIG. 4 and 5 (e.g., a 17.5 mm by 8.3 mm rectangle), and can also include one or more side surfaces of the wick 330*a*–*c* depending in some embodiments upon the shape of the filter 322*a*–*c* and/or the surfaces through which ink flows from the wick 330*a*–*c*. The second interface 376*a*–*c* can also have any other shape desired, such as round, oval, irregular, and other shapes, and can include any number of other surfaces of the wick 330*a*–*c* through which ink passes from the wick 330*a*–*c*.

In some embodiments, one or more surfaces of each wick 330*a*–*c* is covered by a cap 362. The wicks 330*a*–*c* illustrated in FIGS. 4 and 5 can, for example, be each retained in position with respect to the printhead 310 by a cap 362. The cap 362 can be shaped to receive at least part of each wick 330*a*–*c* to perform this function. For example, the cap 362 in the illustrated embodiment of FIGS. 4 and 5 has three apertures 364*a*–*c* shaped and dimensioned to receive the three wicks 330*a*–*c*. Although a single cap 362 can retain all of the wicks 330*a*–*c* in place with respect to the printhead 310, this function can be performed by multiple caps, such as a separate cap for each wick 330*a*–*c*.

With continued reference to FIGS. 4 and 5, the cap 362 is installed on the filter towers 320*a*–*c* (only one of which is visible in FIG. 5). The cap 362 can be directly or indirectly secured to the filter towers 320*a*–*c* in a number of different manner, such as by adhesive or cohesive bonding material, heat staking or welding, one or more screws, rivets, pins, clips, or other conventional fasteners, one or more sets of inter-engaging elements, and the like.

In some embodiments, the cap 362 is shaped to cover one or more filter towers 320*a–c* of the printhead 310 while still retaining one or more wicks 330*a–c* in position with respect to the printhead 310. For this purpose, one or more portions of the cap 362 can extend over the tops of the filter towers 320*a–c*. For example, the cap 362 illustrated in FIGS. 4 and 5 has a flange 366 that extends laterally with respect to the rest of the cap 362, and extends over the tops of the filter towers 320*a–c*. It will be appreciated that the cap 362 can have a number of other shapes still covering one or more filter towers 320*a–c* and falling within the spirit and scope of the present invention.

In the embodiment of FIGS. 4 and 5 for example, the cap 362 is a single element covering portions of the three wicks 330*a–c,* although multiple caps can instead be used to perform this function. The cap 362 can have any shape capable of covering one or more surfaces of the wicks 330*a–c,* and in some embodiments has a substantially planar body 366 in which are defined wick receptacles 382*a–c* positioned to cover surfaces of the wicks 330*a–c*. The wick receptacles 382*a–c* can be shaped to cover and receive at least a portion of the wicks 330*a–c*. In this regard, the wick receptacles 382*a–c* can have any shape performing this function, and in some embodiments have shapes corresponding to the portions of the wicks 330*a–c* received within the wick receptacles 382*a–c*. For example, the wick receptacles 382*a–c* illustrated in FIGS. 4 and 5 have a substantially oval cross-sectional shape to receive a similarly shaped top portion of a respective wick 330*a–c*. In some embodiments, the flange(s) 366 of the cap (if employed) can be used to attach the cap 362 in any suitable manner to the housing 312 of the printhead 310. For example, the flange 366 of the cap 362 illustrated in FIGS. 4 and 5 extend over and is coupled to portions of the housing 312.

The cap 362 in the illustrated embodiment of FIGS. 4 and 5 has three apertures 364*a–c* through which a portion of each wick 330*a–c* is received. The apertures 364*a–c* can have any shape and size. However, apertures 364*a–c* corresponding in size and shape to that portion of each wick 330*a–c* extending therethrough can provide additional advantages described in greater detail below. For example, the apertures 364*a–c* illustrated in FIGS. 4 and 5 are each substantially oval in shape, and are each dimensioned to receive a top portion of a respective wick 330*a–c*.

When the cap 362 is placed over the wicks 330*a–c,* a first portion 384*a–c* of each wick 330*a–c* including the first interface 374*a–c* (through which ink enters each wick 330*a–c*) is exposed to the interior of the receptacle 324 when the receptacle 324 is not occupied by an ink cartridge 326. A second portion 386*a–c* of each wick 330*a–c* including the second interface 376*a–c* (through which ink exits each wick 330*a–c*) is in direct contact with a filter 322*a–c* or is otherwise in fluid communication with the filter 322*a–c*. For example, filters 322*a–c* can be coupled to the filter towers 320*a–c,* and can be configured to cover second interfaces 376*a–c*. The filters 322*a–c* can take any form and be attached in any of the manners previously described.

As best shown in FIG. 5, the wicks 330*a–c* can be in direct contact with the filters 322*a–c,* thereby establishing an interface across which ink can flow from the wicks 330*a–c* to the filters 322*a–c*. By securing the wicks 330*a–c* with respect to the filter towers 320*a–c* and housing 312 as described above, this interface can remain undisturbed during insertion and removal of the ink cartridge 326, thereby reducing the opportunities for the filters 322*a–c* to dry out and cause the printhead 310 to lose prime. The use of elongated wicks 330*a–c* with apertures 364*a–c* in the cap 362 can also reduce the rate at which ink evaporates from the wicks 330*a–c* (and therefore, the likelihood that the wick-to-filter interface will dry out). Therefore, when the ink cartridge 326 is removed from the printhead 310, the wicks 330*a–c* can remain within the printhead 310 with only a relatively small amount of surface area of each wick 330*a–c* exposed to the interior of the receptacle 324.

In some embodiments, substantially all wick surfaces other than the exposed surfaces of the first portion 384*a–c* described above and the surface(s) of the second interface 376*a–c* are covered by the cap 362 and/or walls of the housing 312. Such covered surfaces need not necessarily be in contact with the cap 362 and/or walls of the housing 312, but still lie immediately adjacent the cap 362 and/or walls of the housing 312.

Accordingly, each wick 330*a–c* has an amount of surface area (of the first wick portion 384*a–c*) exposed to the interior of the receptacle 324 (e.g., about 35 $mm^2$ per wick 330*a–c,* in some embodiments) when not occupied by an ink cartridge 326. This surface area can include, but is not necessarily limited to, the first wick interface 374*a–c* described above. It is desirable in some embodiments to limit the amount of this exposed surface area in order to prevent the wicks 330*a–c* from drying out. In some embodiments, this exposed surface area is limited to a size that is smaller than that of the second wick interface 376*a–c* (e.g., about 145 $mm^2$ each, in some embodiments). In the embodiment of FIGS. 4 and 5 for example, the exposed surfaces of the top and upper sides of each wick 330*a–c* is substantially smaller than the second wick interface 376*a–c*. For example, in the illustrated embodiment of FIGS. 4 and 5, the surface area of the second wick interface 376*a–c* is about four (4) times the size of the exposed surface area of the first wick interface 374*a–c*. It will be appreciated that the exposed surface(s) of each wick 330*a–c* are not necessarily the same surfaces that are in contact with each ink retaining medium 338*a–c* (e.g., one or more portions of the wick 330*a–c* can be exposed to the interior of the receptacle 324 when the ink cartridge 326 is removed, yet not be in contact with the ink retaining medium 338*a–c* when the ink cartridge 326 is fully installed).

By covering portions of each wick 330*a–c* with the cap 362, the amount of surface area exposed to the interior of the receptacle 324 can be reduced with respect to the second wick interface 376*a–c,* thereby helping to prevent the filters 322*a–c* from drying out. Although this function can be performed by receiving at least a portion of each wick 330*a–c* within a receptacle 382*a–c* of the cap 362, it will be appreciated that the cap 362 need not necessarily receive the wick 330*a–c* to perform this function (and therefore, need not necessarily have wick receptacles 382*a–c* in other embodiments).

As described above, the wicks 330*a–c* illustrated in FIGS. 4 and 5 each have a first portion 384*a–c* on which the first wick interface 374*a–c* is located and a second portion 386*a–c* on which the second wick interface 376*a–c* is located. In this illustrated embodiment, the cross sectional shape of the first wick portion 384*a–c* is substantially oval, and the cross sectional shape of the second wick portion 386*a–c* is substantially rectangular (wherein the cross sections are taken through each wick 330*a–c* in planes substantially perpendicular through the path of ink flow through each wick 330*a–c*). In this regard, the path of ink flow through a wick 330*a–c* is defined with respect to macroscopic ink flow path rather than the path followed by trace amounts of ink entering and passing through the wick 330*a–c*). In other embodiments, the first and second wick portions 384*a–c,* 386*a–c* can have any other cross-sectional shapes that are the same or different, including without limitation any combination of rectangular, round, oval, irregular, or other cross-sectional shapes. With continued reference to FIGS. 4 and 5, the cross-sectional size of the first wick portion 384*a–c* is different than that of the second wick portion 386*a–c* (again referring to cross-sections taken through the wicks 330*a–c* as described above). It should also be noted that the first wick portion 384*a–c* of each wick 330*a–c* illustrated in FIGS. 4 and 5 also has a substantially smaller volume than the second wick portion 386*a–c*. Therefore, in comparison to the first wick portion 384*a–c,* the second wick portion 386*a–c* can hold a larger amount of ink in a location covered by the cap 362 as described above. This feature can help insure that the second wick interface 376*a–c* does not dry out.

The wicks 330*a–c* illustrated in FIGS. 4 and 5 are each constructed of two elements (first and second portions 384*a–c,* 386*a–c*) connected in any manner. The wicks 330*a–c* can be two or more pieces of high capillary material coupled together by adhesive or cohesive bonding material (e.g., located on respective peripheries of the first and second wick portions 384*a–c,* 386*a–c* in order to avoid interference with flow through the wicks 330*a–c*), by bands or straps, by any number of conventional fasteners, and the like. In other embodiments, the wicks 330*a–c* can each be constructed of a single integral element.

The wicks 330*a–c* illustrated in FIGS. 4 and 5 have an abrupt change in cross-sectional size and shape between the first and second wick interfaces 374*a–c,* 376*a–c*. However, the cross-sectional shape and size of the wicks 330*a–c* can change in any manner desired, such as by one or more gradual changes in cross-sectional shape and/or size between the first and second wick interfaces 374*a–c,* 376*a–c,* one or more stepped changes in cross-sectional shape and/or size, and the like.

In some embodiments, the printhead 310 can have one or more gaskets 390 for preventing ink leakage from between the ink cartridge 326 and the cap 362. Each gasket 390 can have any shape desired, and in some embodiments extends around at least one wick 330*a–c* (and wick receptacle 382*a–c,* if employed). For example, the printhead 310 illustrated in FIGS. 4 and 5 has a single gasket 390 located between the ink cartridge 326 and the cap 362. The gasket 390 is substantially planar, and has apertures 392 through which the wicks 330*a–c* and wick receptacles 382*a–c* extend. In other embodiments, O-rings or any other type of gasket can be positioned between the ink cartridge 326 and the cap 362 (e.g., seated about each wick 330*a–c,* or positioned in any other suitable manner) to confine ink flow to the wicks 330*a–c*.

Prior to installation within the printhead 310, the outlet(s) 336 of the ink cartridge 326 can be covered by one or more covers preventing evaporation or dripping of ink from the ink cartridge 326. The cover can be made of plastic, metal foil, or any other material preventing ink evaporation and dripping, and can have any shape and size capable of performing these functions. Also, the cover can have a pull tab or other portion that can be grasped or otherwise manipulated by a user for removal of the cover. To install the ink cartridge 326, a user can grasp and pull the pull tab, thereby removing the cover to expose the cartridge outlet 336. In other embodiments, the cover might be a substantially flat piece of material such as a removable tape or film covering the cartridge outlet 336, a plug at least partially received within the cartridge outlet 336, a lid or door that can be rotated, slid, or otherwise moved away from a position covering the cartridge outlet 336, and the like. Once the cover (if employed) is removed or moved to expose the cartridge outlet 336, the ink cartridge 326 can be installed within the receptacle 324, thereby establishing fluid communication between fluid within the ink cartridge 326 and the wick 330 as described above.

In some cases, a cartridge-to-wick interface providing reliable fluid communication from the ink cartridge 326 to the wick 330 can be promoted by exerting a pressure from the ink cartridge 326 upon the wick 330. For example, the cartridge ink retaining medium 338 (if used) can be pressed against the wick 330 by exerting a pressure upon the ink cartridge 326. This pressure can be generated in a number of different manners. Two such manners can include a snap-fit engagement between the ink cartridge 326 and the receptacle 324, and by pressure from a lid closed upon the ink cartridge 326.

It should be noted that the printhead 110, 310 and ink cartridges 126, 326 described and illustrated herein can have any orientation. The printheads 110, 310, printhead components, ink cartridges 126, 326, and ink cartridge components are occasionally identified herein and in the appended claims by reference to one or more orientations. Such orientations are referenced only to describe relative positions and orientations of features and elements of the printheads 110, 310, printhead components, ink cartridges 126, 326, and ink cartridge components, rather than to indicate or imply that any particular orientation is required.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A printhead adapted to receive a removable ink cartridge, the printhead comprising:

a receptacle having an interior and adapted to removably receive a removable ink cartridge; and a wick exposed to the interior of the receptacle when the removable ink cartridge is removed from the receptacle, exposure of the wick to the interior of the receptacle restricted to a first external surface area of the wick;

wherein ink flows from the wick to a downstream location in the printhead via a second external surface area of the wick that is greater than the first external surface area of the wick wherein further the first and second external surface areas of the wick have different densities.

2. The printhead as claimed in claim 1, wherein the first external surface area has a different shape than the second external surface area.

3. The printhead as claimed in claim 1, wherein the second external area is substantially greater than the first external surface area.

4. The printhead as claimed in claim 3, wherein the second external surface is about four times the size of the first external surface.

5. The printhead as claimed in claim 2, wherein:

the first external surface area is generally round; and the second external surface area is generally rectangular.

6. The printhead as claimed in claim 2, wherein:

the first external surface area is generally ovular; and the second external surface area is generally rectangular.

7. The printhead as claimed in claim 1, wherein the first external surface area is generally rectangular in shape.

8. The printhead as claimed in claim 1, wherein a portion of the wick that is exposed in chamfered.

9. The printhead as claimed in claim 1, wherein the first external surface area comprises top and side surfaces of the wick.

10. The printhead as claimed in claim 1, further comprising a cap coupled to the wick and at least partially retaining the wick in a position with respect to the receptacle.

11. The printhead as claimed in claim 10, wherein the wick extends through the cap.

12. The printhead as claimed in claim 10, wherein the cap comprises:

a body defining a wick receptacle in which at least a part of the wick is received; and an aperture defined in the body and through which the wick extends.

13. The printhead as claimed in claim 10, further comprising:

a filter tower; and a filter located adjacent the filter tower and in fluid communication with the wick.

14. The printhead as claimed in claim 10, further comprising a filter coupled to the cap.

15. The printhead as claimed in claim 14, wherein:

the filter is disposed at an angle with respect to a chip that is attached to the printhead; and the second external surface area is configured to mate with the angled filter.

16. The printhead as claimed in claim 10, wherein the cap separates at least a portion of the wick from an interior of the receptacle.

17. The printhead as claimed in claim 10, wherein the cap comprises a flange extending across a portion of the wick.

18. The printhead as claimed in claim 10, further comprising a filter tower extending into the receptacle, wherein the cap comprises a flange extending across the filter tower.

19. The printhead a claimed in claim 10, further comprising a gasket located and defining a seal between the cap and an ink cartridge when the ink cartridge is received in the receptacle.

20. The printhead as claimed in claim 1, wherein the wick is a single integral element.

21. The printhead as claimed in claim 1, wherein the wick is positioned to contact the removable ink cartridge when the removable ink cartridge is installed in the printhead.

22. The printhead as claimed in claim 1, wherein the receptacle is adapted to removably receive the ink cartridge from a side of the printhead.

23. An ink cartridge configured to operatively cooperate with the printhead of claim 1.

24. The ink cartridge as claimed in claim 23, wherein the ink cartridge includes at least one groove configured to receive at least one wall in the receptacle.

25. A printhead adapted to receive a removable ink cartridge, the printhead comprising:

a receptacle dimensioned to receive a removable ink cartridge;

a nozzle through which ink exits a printhead;

a filter located in the fluid path extending from the receptacle of the nozzle;

a wick having a first portion positioned to be releasably coupled to the outlet of the removable cartridge when the removable ink cartridge is installed within the receptacle, the first portion having a total amount of surface area exposed to an interior of the receptacle when the removable ink cartridge is removed from the receptacle; and a second portion coupled to the filter and located along the fluid path downstream of the first portion, the second portion having a total amount of surface area in contact with the filter, wherein the total amount of the surface area of the wick exposed to the interior of the receptacle when the removable ink cartridge is removed is less than the total amount of the surface area of the wick in contact with the filter; and a cap coupled to the wick and in contact with the filter.

26. The printhead's claimed in claim 25, wherein:

the first and second portions each have a cross-sectional shape taken in places substantially perpendicular to the fluid path; and the cross-sectional shape of the first portion is different from the cross-sectional shape of the second portion.

27. The printhead as claimed in claim 25, wherein the cap at least partially retains the wick in a position with respect to the receptacle.

28. The printhead as claimed in claim 27, wherein the wick extends through the cap.

29. The printhead as claimed in claim 27, further comprising:

a receptacle defined in the cap, the receptacle in the cap dimensioned to receive at least part of the wick; and an aperture defined in the receptacle and through which the wick extends.

30. The printhead as claimed in claim 27, further comprising a filter tower extending towards the receptacle, wherein the filter is located adjacent the filter tower.

31. The printhead as claimed in claim 27, wherein at least a portion of the cap separates a surface of the wick from the receptacle.

32. The printhead as claimed in claim 27, further comprising:

a filter tower extending towards the receptacle; and a flange of the cap extending over at least a portion of the filter tower.

33. The printhead as claimed in claim 25, the first portion of the wick is positioned to contact the outlet of the removable ink cartridge when the removable ink cartridge is installed within the receptacle.

34. An ink cartridge configured to operatively cooperate with the printhead of claim 25.

35. A printhead adapted to receive a removable ink cartridge, the printhead a comprising:

a housing; and a wick, a portion of which is generally rectangular in the shape, is positioned with respect to the housing to be releasably coupled to an ink cartridge when the removable ink cartridge is installed in the printhead, the wick comprising:

at least one surface defining a first interface through which ink enters the wick from the removable ink cartridge;

at least one surface defining a second interface through which ink exits the wick; and a cross-sectional area defined by a plane substantially perpendicular to an ink flow path extending from the first interface to the second interface, wherein the cross-sectional area of the wick changes between the first interface and the second interface to the wick.

36. The printhead as claimed in claim 35, wherein:

the cross-sectional area of the wick has a cross-sectional shape; and the cross-sectional shape changes between the first interface and the second interface of the wick.

37. The printhead as claimed in claim 35, further comprising a cap at least partially retaining the wick in a position with respect to the housing.

38. The printhead as claimed in claim 37, wherein the wick extends through the cap.

39. The printhead as claimed in claim 37, further comprising:

a receptacle defined in the cap and adapted to receive at least a portion of the wick; and an aperture defined in the cap and through which the wick extends.

40. The printhead as claimed in claim 37, further comprising:

a filter to which ink flows from the wick; and a filter tower extending within the housing and to which the filter is coupled.

41. The printhead as claimed in claim 37, wherein the cap covers an area of the wick adjacent the first interface.

42. The printhead as claimed in claim 35, wherein the first interface of the wick is positioned to contact the removable ink cartridge when the removable ink cartridge is installed in the printhead.

43. The printhead as claimed in claim 35, further comprising a filter to which ink flows from the second interface of the wick, wherein the second interface of the wick is in contact with the filter.

44. An ink cartridge configured to operatively cooperate with the printhead of claim 35.

* * * * *